US008056359B2

(12) United States Patent
Smith et al.

(10) Patent No.: US 8,056,359 B2
(45) Date of Patent: Nov. 15, 2011

(54) FAST FREEZE SHELF

(75) Inventors: John R. Smith, Ashland City, TN (US); Joel Benjamin Kelso, Rice, MN (US); Mary Catherine Stommes, Cold Spring, MN (US)

(73) Assignee: Electrolux Home Products, Inc., Charlotte, NC (US)

( * ) Notice: Subject to any disclaimer, the term of this patent is extended or adjusted under 35 U.S.C. 154(b) by 732 days.

(21) Appl. No.: 12/170,011

(22) Filed: Jul. 9, 2008

(65) Prior Publication Data

US 2009/0064707 A1 Mar. 12, 2009

Related U.S. Application Data

(60) Provisional application No. 60/948,517, filed on Jul. 9, 2007.

(51) Int. Cl.
*F25D 3/02* (2006.01)

(52) U.S. Cl. ..... 62/459; 62/257; 62/457.9; 62/529

(58) Field of Classification Search ..... 62/237, 62/249, 251, 257, 430, 431, 459, 520, 529, 62/530, 457.9
See application file for complete search history.

(56) References Cited

U.S. PATENT DOCUMENTS

| | | | | | |
|---|---|---|---|---|---|
| 1,965,205 | A | * | 7/1934 | Smith | 62/166 |
| 2,033,554 | A | * | 3/1936 | Smith | 62/333 |
| 2,174,455 | A | * | 9/1939 | Bates | 62/530 |
| 2,268,885 | A | | 1/1942 | McCullough | |
| 2,428,311 | A | * | 9/1947 | Herbener | 62/157 |
| 2,477,210 | A | | 7/1949 | Skinner | |
| 2,511,125 | A | * | 6/1950 | Philipp | 62/288 |
| 3,169,383 | A | | 2/1965 | Morton et al. | |
| 3,232,072 | A | | 2/1966 | Barroero | |
| 4,306,616 | A | | 12/1981 | Woods, Jr. et al. | |
| 4,459,826 | A | * | 7/1984 | Hirano et al. | 62/430 |
| 4,671,074 | A | | 6/1987 | Gostelow et al. | |
| 5,156,021 | A | | 10/1992 | St-Gelais et al. | |
| 5,701,745 | A | | 12/1997 | Cheng et al. | |
| 5,720,185 | A | | 2/1998 | Lee | |
| 5,893,620 | A | * | 4/1999 | Birgelis | 312/408 |
| 6,626,508 | B1 | * | 9/2003 | Hase et al. | 312/236 |
| 2007/0051127 | A1 | | 3/2007 | McMillin | |

* cited by examiner

*Primary Examiner* — Melvin Jones
(74) *Attorney, Agent, or Firm* — Pearne & Gordon LLP

(57) ABSTRACT

A refrigeration appliance includes an insulated cabinet forming an interior cavity and a refrigeration system for cooling the interior cavity. A thermally conductive shelf forms a support surface within the interior cavity, and a thermal sink is operatively coupled to the conductive shelf. The thermal sink is adapted to facilitate the transfer of thermal energy from the thermally conductive shelf. In one example, the thermal sink includes a plurality of thermal sinks operatively coupled to the conductive shelf. In another example, the thermal sink is removable from the interior cavity.

20 Claims, 14 Drawing Sheets

FAST FREEZE SHELF

RELATED APPLICATIONS

This application claims the benefit of U.S. Provisional Application No. 60/948,517, filed on Jul. 9, 2007, the entire disclosure of which is hereby incorporated herein by reference.

FIELD OF THE INVENTION

The present invention relates generally to a shelf of a refrigeration appliance, and more particularly, to a thermally conductive shelf of a refrigeration appliance.

BACKGROUND OF THE INVENTION

Refrigeration appliances, such as refrigerators, freezers, and the like, commonly include an insulated cabinet forming an interior cavity, and a refrigeration system for cooling the interior cavity. Moreover, refrigeration appliances also commonly include one or more shelves within the interior cavity for supporting various items to be cooled, such as food, ice, utensils, etc. It would be desirable to provide a shelf that facilitates the cooling of an object supported thereon.

BRIEF SUMMARY OF THE INVENTION

The following presents a simplified summary of the invention in order to provide a basic understanding of some aspects of the invention. This summary is not an extensive overview of the invention. It is intended to identify neither key nor critical elements of the invention nor delineate the scope of the invention. Its sole purpose is to present some concepts of the invention in a simplified form as a prelude to the more detailed description that is presented later.

In accordance with an aspect of the present invention, refrigeration appliance includes an insulated cabinet forming an interior cavity and a refrigeration system for cooling the interior cavity. A thermally conductive shelf extends across at least a portion of the interior cavity to form a support surface, and a thermal sink operatively coupled to the conductive shelf. The thermal sink is adapted to facilitate the transfer of thermal energy from the thermally conductive shelf.

In accordance with another aspect of the present invention, a refrigeration appliance includes an insulated cabinet forming an interior cavity, and a refrigeration system for cooling the interior cavity. A thermally conductive shelf forms a support surface within the interior cavity, and a plurality of thermal sinks is operatively coupled to the conductive shelf. The plurality of thermal sinks are adapted to facilitate the transfer of thermal energy from the thermally conductive shelf. At least one of the plurality of thermal sinks is removable from the interior cavity.

In accordance with yet another aspect of the present invention, a refrigeration appliance includes an insulated cabinet forming an interior cavity, and a refrigeration system for cooling the interior cavity. A support rack is operatively coupled to a portion of the interior cavity, and a thermally conductive shelf is coupled to the support rack and extends across at least a portion of the interior cavity to form a support surface. A thermal sink is thermally coupled to the conductive shelf and is adapted to facilitate the transfer of thermal energy from the thermally conductive shelf.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
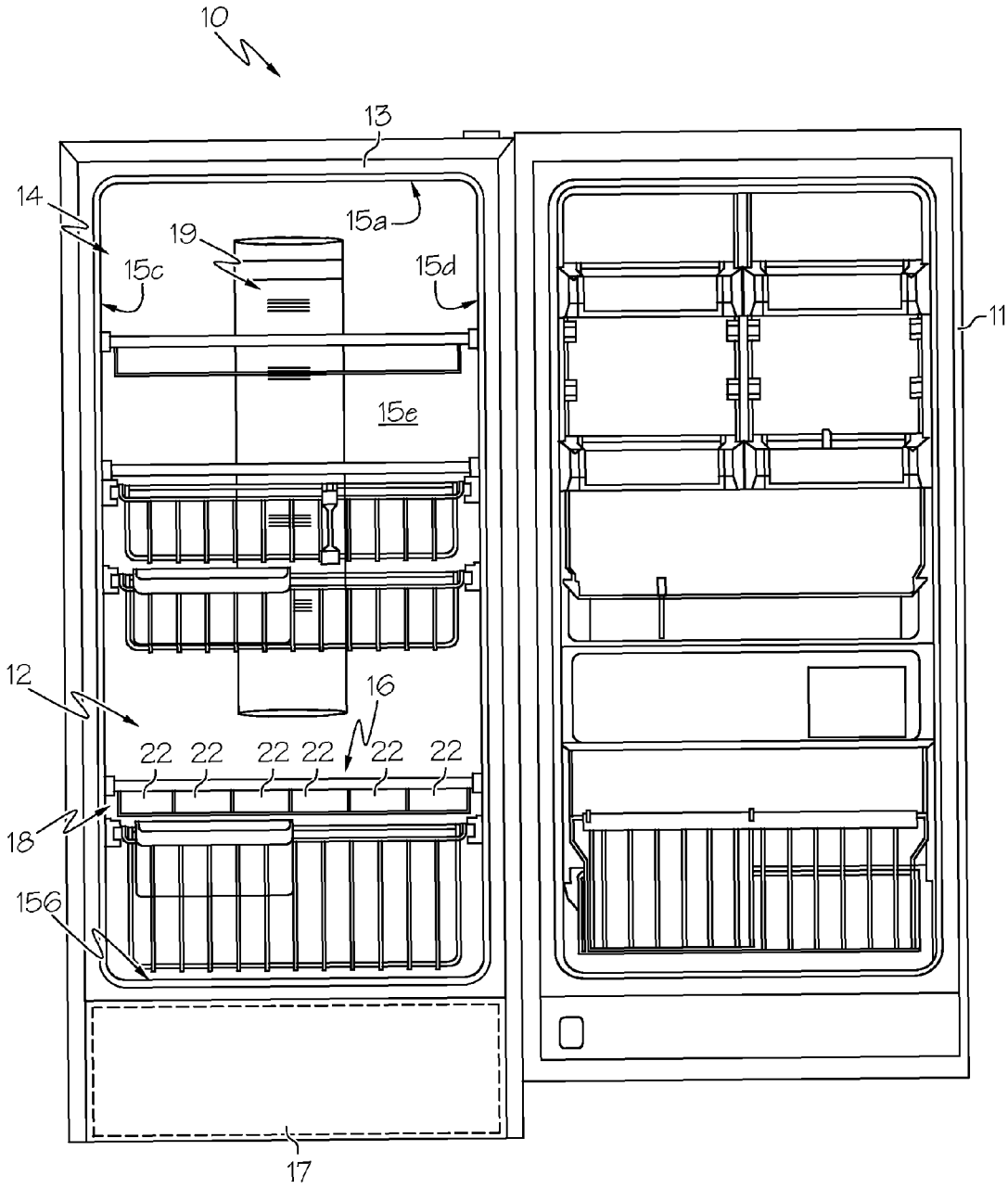
FIG. 1 illustrates a front view of an example refrigeration appliance including an example fast freeze shelf in accordance with an aspect of the present invention.

An example embodiment of a device that incorporates aspects of the present invention is shown in the drawings. It is to be appreciated that the shown example is not intended to be a limitation on the present invention. For example, one or more aspects of the present invention can be utilized in other embodiments and even other types of devices.

Figure 2:
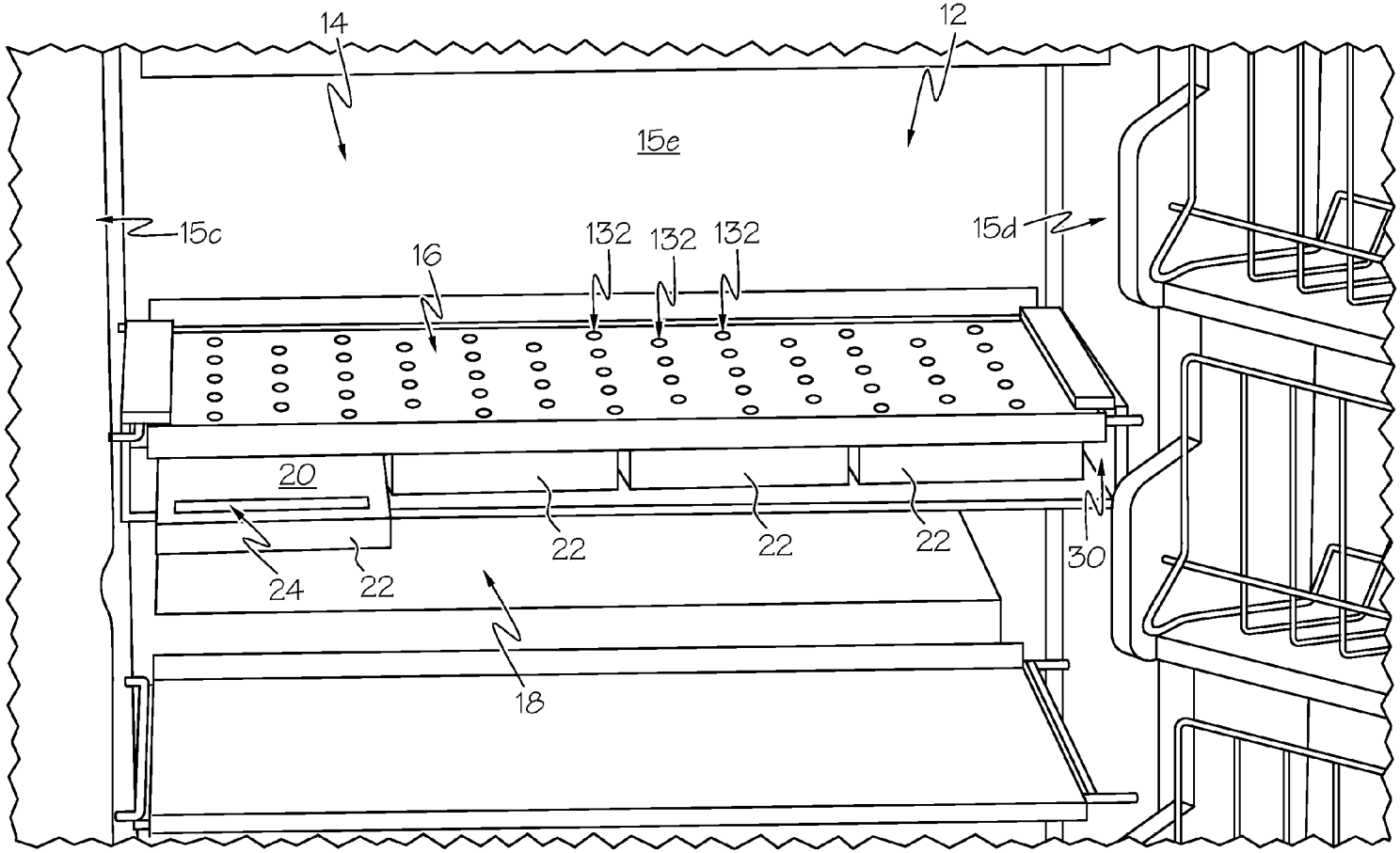
FIG. 2 illustrates a perspective, detail view of the fast freeze shelf of FIG. 1.

Turning to the shown examples of FIGS. 1-2, a refrigeration appliance 10 includes an example fast freeze shelf 12 in accordance with an aspect of the present invention. As shown, the refrigeration appliance 10 can be a freezer, such as a stand-alone freezer, though the fast freeze shelf 12 can be used in various other appliances, such as a refrigerator incorporating a freezer compartment or even a fresh food compartment of the refrigerator. In still other examples, the fast freeze shelf can be utilized in various portable refrigeration appliances, such as actively or passively-cooled portable coolers or the like. Of course, the fast freeze shelf can be used in a freezer compartment (i.e., below zero degrees centigrade) and/or even in a non-frozen (i.e., above zero degrees centigrade) compartment. As will be discussed more fully herein, the fast freeze shelf 12 is adapted to quickly cool items placed thereupon.

For purposes of the following examples, the fast freeze shelf 12 will be described with respect to a freezer compartment of a refrigeration appliance 10. The refrigeration appliance 10 can generally include an insulated cabinet 13 forming an interior cavity, and the fast freeze shelf 12 can be generally located within the interior freezer compartment 14 (i.e., the interior cavity of the cabinet 13) and be exposed to the cold temperatures therein. The insulated cabinet 13 can generally include an upper wall 15*a*, a lower wall 15*b*, opposed first and second sidewalls 15*c*, 15*d* extending between the upper and lower walls 15*a*, 15*b*, and a rear wall 15*e* extending between the upper and lower walls 15*a*, 15*b*. Moreover, the interior cavity 14 of the cabinet 13 can be selectively closed by a door 11 pivotally coupled to the cabinet 13. Moreover, the refrigeration appliance 10 can include a refrigeration system 17 for cooling the interior cavity 14, such as an evaporative cooling system, absorption cooling system, thermoelectric cooling system, etc. The refrigeration system 17 can also utilize fans or the like to blow cooled air into the interior cavity 14 via one or more air vents 19 or the like.

Generally, the fast freeze shelf 12 includes a thermally conductive shelf 16 forming a support surface within the interior cavity 14 for supporting an object to be cooled, such as food, ice, utensils, etc. (not shown). The conductive shelf 16 generally extends across a portion of the interior cavity 14, and is formed of one or more thermally conductive, generally rigid materials, such as metal, glass, plastic, hard rubber, ceramic, etc. As can be appreciated, it can be beneficial to form the thermally conductive shelf 16 from a relatively highly thermally conductive material (e.g., metal) so as to increase the speed at which articles placed thereon will lower in temperature. In one example, the thermally conductive shelf 16 can be formed of aluminum or steel, though various other materials, combinations, and/or composites can also be used. Moreover, the shelf 16 can have utilize various thicknesses of material to alter the transfer of thermal energy between the conductive shelf 16 and an object supported upon the conductive shelf 16. In various examples, the shelf 16 can have a thickness of 1/16", 1/8", 3/16", 1/4", 3/8" or 1/2", though various other greater and lesser thicknesses are also contemplated. In another example, the thermally conductive shelf 16 can have an additional heat transfer layer (not shown), such as a layer of copper or other material having a relatively high (or even relatively lower) heat transfer ability to thereby relatively increase (or even relatively decrease) the thermal conductivity of the shelf 12. In still yet another example, a portion of the shelf 12 can include insulation or the like.

Though highly thermally conductive materials can be beneficial, the shelf 12 benefit from a relatively greater thermal mass so as to provide relatively quicker cooling over time, such as for use in cooling or freezing relatively large items. Thus, the shelf 12 can include various features for relatively increasing the thermal mass and/or otherwise facilitate the transfer of thermal energy between the shelf 16 and an object supported upon the shelf 16. In one example, the thermally conductive shelf 16 can have a relatively large size and/or thickness so as to provide an increased shelf mass. In one example, the thermally conductive shelf 16 can have dimensions of approximately 25 inches wide, 14 inches deep, and 1/8" (1/8 inch) thickness, though various other dimensions are also contemplated.

In addition or alternatively, the fast freeze shelf 12 can include a thermal sink 18 operatively coupled to the thermally conductive shelf 16 to further increase the overall thermal mass and/or otherwise facilitate the transfer of thermal energy between the shelf 16 and an object supported upon the shelf 16. In one example, the thermal sink 18 can be located generally below and in thermal contact with (i.e., thermally coupled to) the thermally conductive shelf 16, though it can also be located at various other locations adjacent to the thermally conductive shelf 16. The thermal sink 18 can include various materials in solid, liquid, and/or gaseous states, or various combinations thereof. As can be appreciated, the thermal sink 18 can include a material having a relatively moderate or high thermal capacity so as to be able to accept heat transfer from the thermally conductive shelf 16 due to items placed thereon. In various examples, the thermal sink 18 can include generally solid materials, such as metals, ceramics, hard rubber, etc. In addition or alternatively, the thermal sink 18 can include frozen materials, such as frozen water (e.g., ice), frozen gels, and/or various other frozen liquids. For example, various frozen gels (e.g., freezer gels and the like) that are manufactured for use in a below zero-degree-centigrade environment can be configured to have little or substantially no physical expansion. In still yet other examples, the thermal sink 18 can include various materials adapted to change phase (i.e., solid, liquid, gas) within the freezer compartment 14. For example, the thermal sink 18 can include a thermally conductive material that becomes a liquid at a temperature above approximately zero degrees centigrade and a solid at a temperature below approximately zero degrees centigrade, though various other temperature ranges are also contemplated. In addition or alternatively, the thermal sink 18 can include various liquids, including liquids that have a freezing point generally below the temperature of the freezer compartment 14 so as to remain in a generally liquid state while maintained within the freezer compartment 14 for extended periods of time.

Figure 3:
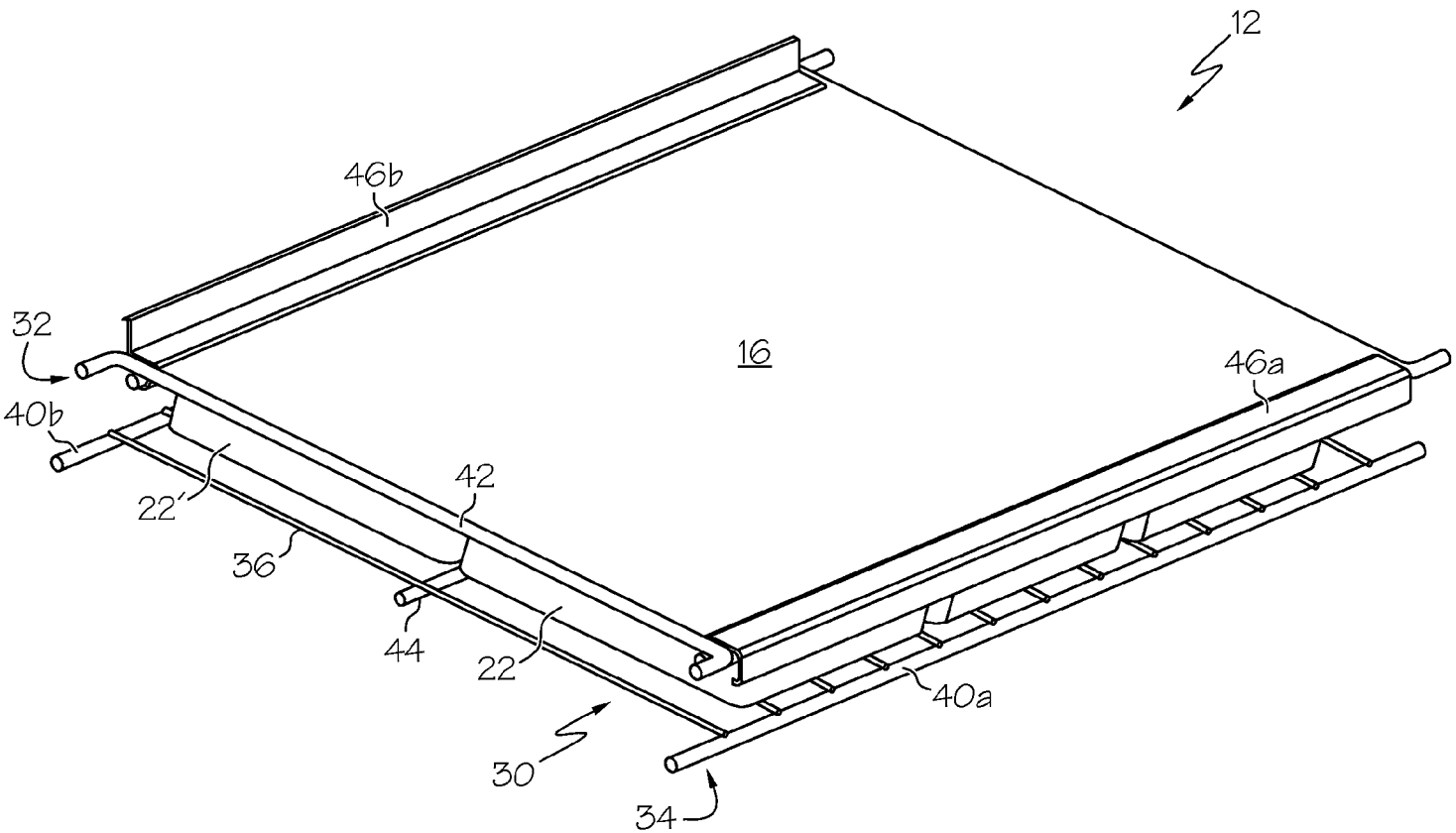
FIG. 3 illustrates a perspective view of example construction of a fast freeze shelf in accordance with another aspect of the present invention.
Figure 6:
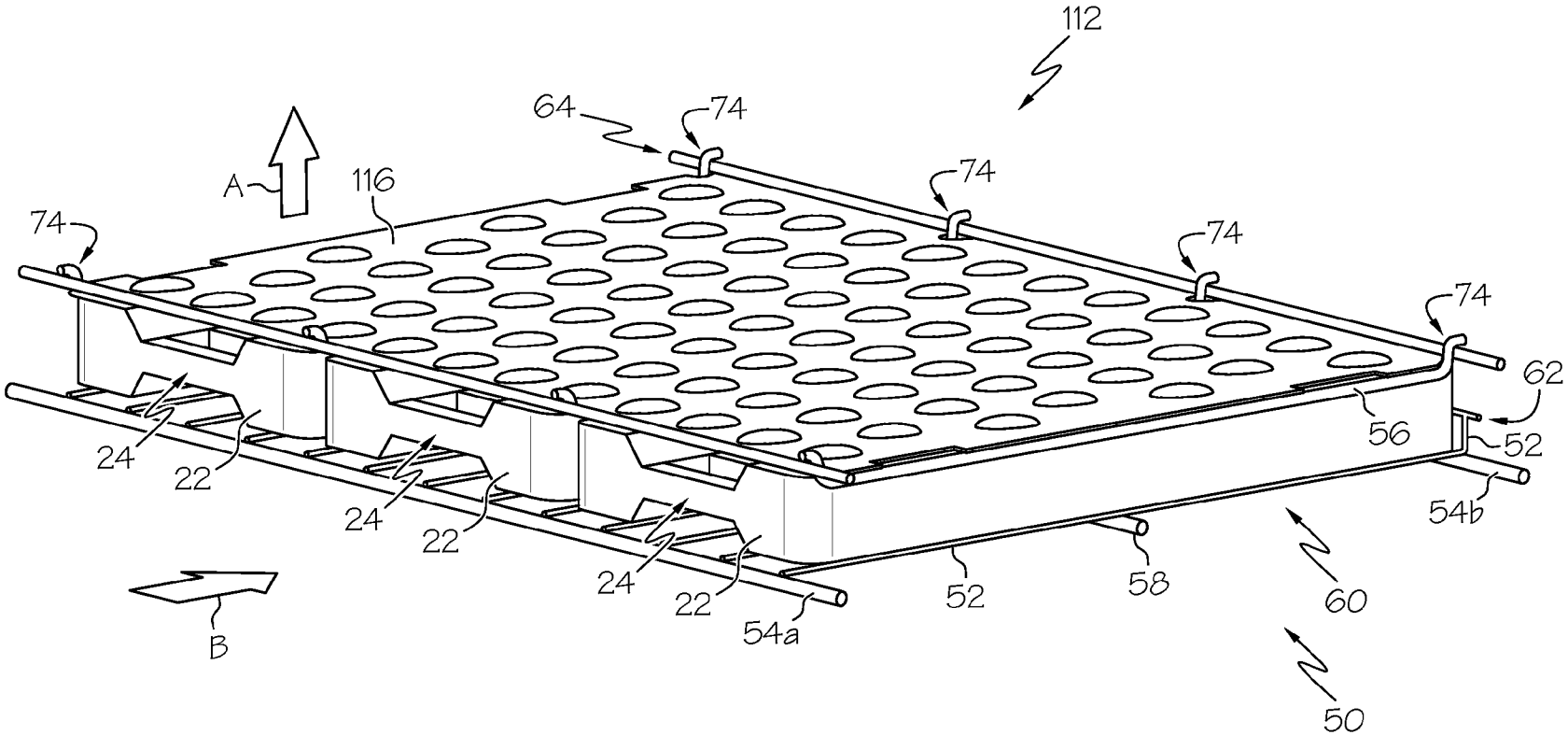
FIG. 6 illustrates a perspective view of another example construction of a fast freeze shelf in accordance with another aspect of the present invention.

In one example, as shown in FIG. 2, the thermal sink 18 can include a frozen material, such as frozen water (e.g., ice), frozen gels, and/or various other frozen liquids or other materials contained within a protective shell 20. The protective shell 20 can include various flexible or rigid materials. In the shown example, the protective shell 20 includes a plastic material, though others can also be used. In addition or alternatively, the thermal sink 22 can be separated into a plurality of thermal sinks 22 each contained within a separate protective shell 20. In other words, each protective shell 20 containing the frozen material can comprise a separate thermal sink 22. For example, the thermal sink 18 can include six thermal sinks 22 as shown in FIG. 1, while four are shown in FIG. 2. In another example, as shown in FIG. 3, the thermal sink 18 can include a total of six thermal sinks 22 wherein a first set of thermal sinks 22 is located towards the front of the shelf 12, and a second set of thermal sinks 22' is located towards the rear of the shelf 12. In yet another example, as shown in FIG. 6, the thermal sink 18 can include three thermal sinks 22. As can be appreciated, various numbers of thermal sinks 22 can be used depending upon the specific design and/or the specific performance desired of the fast freeze shelf 12. Moreover, the size and/or number of thermal sinks 22 can be adjusted depending upon how much of the shelf 16 it is desired to be in thermal contact with the thermal sinks 22. In various examples, it can be desired to have more than 50%, more than 75%, more than 90%, or even substantially 100% of the shelf 16 in thermal contact with the thermal sinks 22. However, it is to be understood that any or all of the features of the various thermal sinks described herein can apply to either a single thermal sink 18 or to any or all of a plurality of the thermal sinks 22.

In addition or alternatively, the thermal sinks 22 can be completely sealed, or can even be adapted to permit re-filling or removal (e.g., for making ice blocks or the like) of the frozen material. For example, where a frozen gel is used, the thermal sinks 22 can be completely sealed so as to inhibit leakage of the gel and/or user contact therewith. In another example, where water (e.g., ice) is used, the thermal sinks 22 can be adapted to permit a user to refill the thermal sinks 22 with new water. For example, turning briefly to FIG. 13, the thermal sinks 22 can include a fill opening 21 sealed by a removable cap or the like. Further, the thermal sinks 22 can include materials and/or structure to maintain sanitary conditions, such as anti-microbial materials contained within the thermal sink 22, or even formed with the protective shell 20. Moreover, each of the thermal sinks 22 can have various internal volumes for containing the desired material (i.e., water, ice, gel, solid, etc.). In one example, where the thermal sink 18 include three thermal sinks 22, each thermal sink 22 can have an internal volume of approximately 550 cubic centimeters, though various other greater and lesser internal volumes are also contemplated.

Further still, the various thermal sinks 22 can include various sizes and/or geometries depending upon the specific designs and/or specific performance desired of the fast freeze shelf 12. For example, as shown, the various thermal sinks 22 can have a generally rectangular geometry so as to provide a relatively flat surface to relatively increase the surface area contact between the thermal sinks 22 and the underside of the thermally conductive shelf 16 to thereby relatively increase heat transfer therebetween. In another example (not shown), the various thermal sinks 22 can have a generally curved geometry (e.g., a tubular geometry) for decreasing the surface area contact between the thermal sinks 22 and the underside of the thermally conductive shelf 16 to thereby relatively decrease heat transfer. Still, various other geometries are contemplated.

Figure 13:
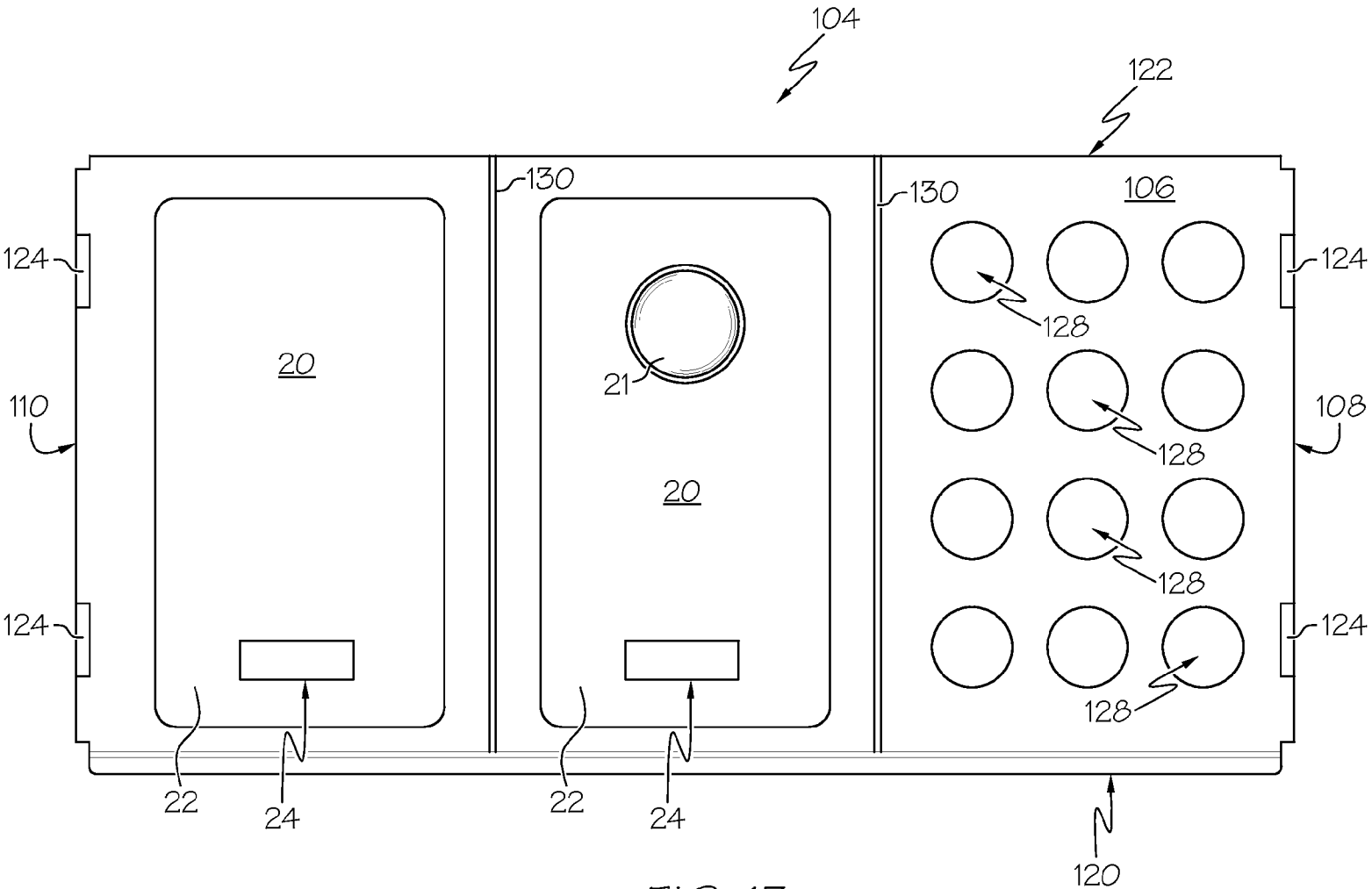
FIG. 13 illustrates a top view of an example lower support portion of the fast freeze shelf of FIG. 12.

Any or all of the various thermal sinks 22 can be removable or non-removable from the fast freeze shelf 12. For example, as shown in FIGS. 2, 6, and 13, the thermal sinks 22 can include a handle 24 to facilitate removal of the thermal sink 22 from the fast freeze shelf 12. For example, the handle 24 can include a recess and/or through-aperture of the protective shell 20. The thermal sinks 22 can be removable from the shelf 12 for various reasons, such as replacement, repair, refilling, etc. In one example, a user can remove one or more thermal sinks 22 from the shelf 12 for use in other applications, such as for use in a portable cooler or the like. In another example (not shown), the thermal sinks 22 can be configured to be useful as water bottles that a user can take with them to drink the water (or other potable liquid) contained therein as the ice gradually melts into water over time. Then, a user can refill the water bottle thermal sink (e.g., such as through the fill opening 21) and return it to the fast freeze shelf 12 for increasing the operation of the shelf 12 until subsequently removed again. In still yet another example, the thermal sink 22 can be configured to provide ice cubes of varying sizes and geometries.

The fast freeze shelf 12 can be supported within the freezer compartment 14 in various manners. For example, the fast freeze shelf 12 can be directly or indirectly and/or removably or non-removably coupled to any of the various walls 15*a*-15*e* of the freezer compartment 14, as shown, and/or can be supported in various other manners, such as by another shelf, etc. In one example, a support rack can be coupled to a portion of the interior cavity 14 for supporting the fast freeze shelf 12 therein. Various example support rack constructions will now be discussed.

Figure 4:
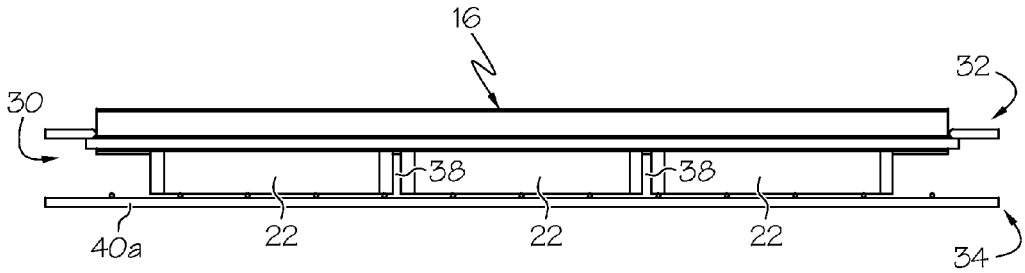
FIG. 4 illustrates a front view of the example fast freeze shelf of FIG. 3.
Figure 5:
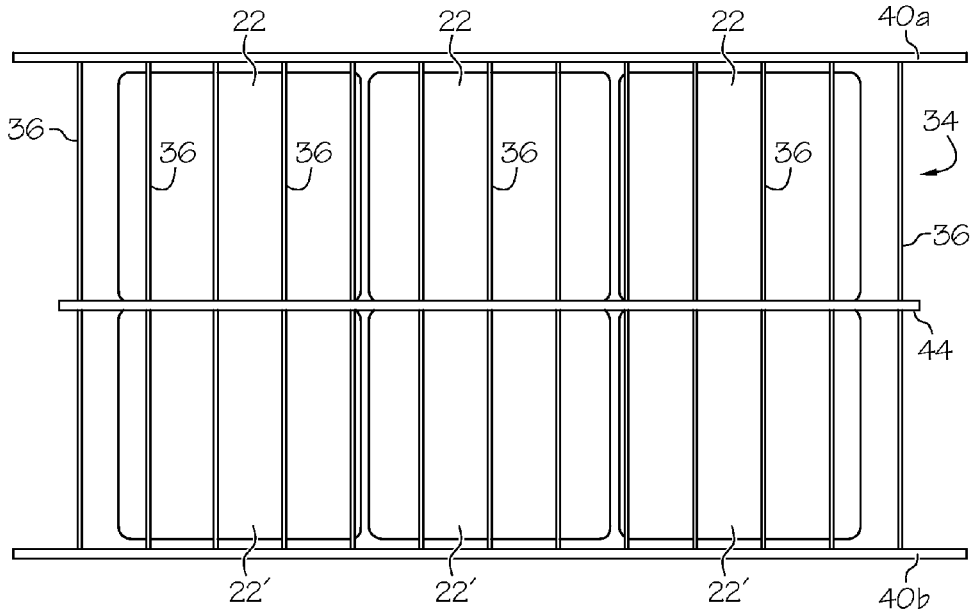
FIG. 5 illustrates a bottom view of the example fast freeze shelf of FIG. 3.

Turning to FIGS. 3-5, one example support rack 30 is illustrated for supporting the thermally conductive shelf 16 within the freezer compartment 14. The support rack 30 can include a wire rack formed of a plurality of wire that can support the thermally conductive shelf 16 above the thermal sinks 22. The thermally conductive shelf 16 can be removably or non-removably coupled to the support rack 30. The wire rack can include an upper support portion 32 and a lower support portion 34. The upper support portion 32 can retain and support the thermally conductive shelf 16, while the lower support portion 34 can retain and support the thermal sinks 22. Intermediate wire supports 38 can be attached between the upper and lower support portions 32, 34 to provide support therefore, to provide a spacing gap for receiving the thermal sinks 22, and/or for controlling the amount of contact between the thermal sinks 22 and the thermally conductive shelf 16. For example, the upper and lower support portions 32, 34 can be respectively located, via the intermediate wire supports 38, such that the thermally conductive shelf 16 is spaced from the lower support portion 34 a distance generally equal to or less than a thickness of the thermal sinks 22. Thus, upon insertion of the thermal sink(s) 22 onto the lower support portion 34, the thermally conductive shelf 16 will be thermally coupled, via close thermal engagement and/or conduction, with the thermal sinks 22 to facilitate the transfer of thermal energy therebetween. Still, it is to be understood that the shelf 16 can also be indirectly thermally coupled to the thermal sinks 22 via the support rack 30.

In addition or alternatively, the intermediate wire supports 38 can be arranged to generally define separate storage locations for each thermal sink 22, and/or can act as guides to facilitate insertion and/or removal of the thermal sinks 22. In yet an example, each of the upper and lower wire supports 32, 34 can be individually supported within the refrigeration appliance 10. For example, as shown in FIG. 2, either or both of the upper and lower support portions 32, 34 can be supported by the interior walls of the refrigeration appliance 10. For example, as shown in FIG. 3, the upper support portion 32 can be completely separate and independent from the lower support portion 34, and can be independently coupled to the walls 15*a*-15*e* of the cabinet 13.

As shown, the wire support rack 30 can be of wire-form construction constituted by a plurality of fore-to-aft and laterally spaced wires 36 that are substantially evenly spaced across the entire rack forming a support plane for supporting the thermally conductive shelf 16 and/or thermal sinks 22. The laterally spaced wires 36 can be supported between front and rear wires 40*a*, 40*b*, and/or even opposed side wires 42. In addition or alternatively, additional support wires 44 can be utilized to provide additional loading support and/or structural stability to the laterally spaced wires 36. Even further still, the support rack 30 can be coupled to a portion of the interior cavity 14 of the insulated cabinet 13 via any or all of the laterally spaced wires 36, front, rear, and side wires 40*a*, 40*b*, 42, and additional support wires 44. For example, any or all of the wires 36, 40*a*, 40*b*, 42, 44 can include outwardly extending ends that can be received by corresponding structure (e.g., apertures, rails, vertical supports, etc.) of the various walls 15*a*-15*e* of the cabinet for support of the wire support rack 30 therein, such as is illustrated in FIG. 2.

The wires can be constructed from metal wire, such as iron coated with nickel or steel coated with porcelain, though they can be also constructed from various other coated or non-coated suitable materials (e.g., aluminum, sheet metal, plastic, or the like). Further, the wires can be attached together to form the wire support rack 30 in various manners, such as by welding, adhesives, or fasteners, and/or can even be formed from a single piece of wire. As shown, the wire support rack 30 can have a generally rectangular geometry, while the individual wires 36, 40*a*, 40*b*, 42, 44 can have a generally circular cross-section, through either can also have various other geometries. Additionally, the wire support rack 30 can include various geometries and/or structures to facilitate support thereof within the appliance. In addition or alternatively, the wire support rack 30 can also include various trim pieces 46*a*, 46*b* removably or non-removably coupled thereto to provide a more pleasing visual appearance and/or a more streamlined construction. In another example, the trim pieces 46*a*, 46*b* can provide a fore-stop, backstop, and/or other structure for limiting movement of items stored on the conductive shelf 16.

Turning now to FIGS. 6-9, another example support rack 50 is illustrated for supporting the thermally conductive shelf 116 within the freezer compartment 14. It is to be appreciated that the fast freeze shelf 112 and the thermally conductive shelf 116 can be identical, similar, or even different than those previously described herein. As before, the support rack 50 can be of wire-form construction, and can include any or all of the laterally spaced wires 52, front, rear, and side wires 54*a*, 54*b*, 56, and additional support wires 58, etc.

The support rack 50 can also include various other features. In one example, the lower and upper support portions 60, 64 can be separate elements that are independently supported within the freezer compartment 14. In another example, the lower support portion 60 can include a backstop 62 to limit an insertion distance of the thermal sink(s) 22. For example, as shown, a rearward portion of the laterally spaced wires 52 can be upturned to provide the backstop 62.

In another example, the upper support portion 64 can include a plurality of side wires 56, and/or intermediate wires 66, extending between front and rear wires 68*a*, 68*b*. The plurality of side wires 56 and intermediate wires 66 can be coupled to the front and rear wires 68*a*, 68*b* via a step-down geometry 74 so as to provide a recessed support plane 72 configured to receive and support the thermally conductive shelf 116. Additionally, the thermally conductive shelf 116 can include a plurality of corresponding apertures 76 for receiving the step-down geometry 74 of the plurality of side wires 56 and intermediate wires 66. Thus, the thermally conductive shelf 116 can be received by the recessed support plane 72.

In addition or alternatively, the apertures 76 of the thermally conductive shelf 116 can be configured to permit the shelf 116 to be vertically movable relative to the upper support portion 64, such as along the direction of arrow A (see FIG. 6). In other words, the apertures 76 can have an appropriate size and/or geometry to permit the step-down geometry 74 to ride therein while the shelf 116 is vertically moved relative to the plurality of side wires 56 and intermediate wires 66. For example, the thermally conductive shelf 116 can be supported by the upper support portion 64 so as to be spaced from the lower support portion 60 a distance generally equal to or less than a thickness of the thermal sinks 22. Thus, upon insertion of the thermal sink(s) 22 onto the lower support portion 60 along the direction of arrow B, the thermal sinks 22 will be in abutment and/or otherwise engage the thermally conductive shelf 116 to lift the shelf 116 vertically along the direction of arrow A. Therefore, the thermally conductive shelf 116 will rest directly upon and be thermally coupled, via close thermal engagement and/or conduction, with the thermal sinks 22 to facilitate the transfer of thermal energy therebetween. Moreover, the support rack 50 and/or the shelf 116 can also include structure to limit the vertical movement of the shelf 116 relative to the support rack 50, such as to prevent the shelf 116 from inadvertently falling off of the support rack 50.

Figure 10:
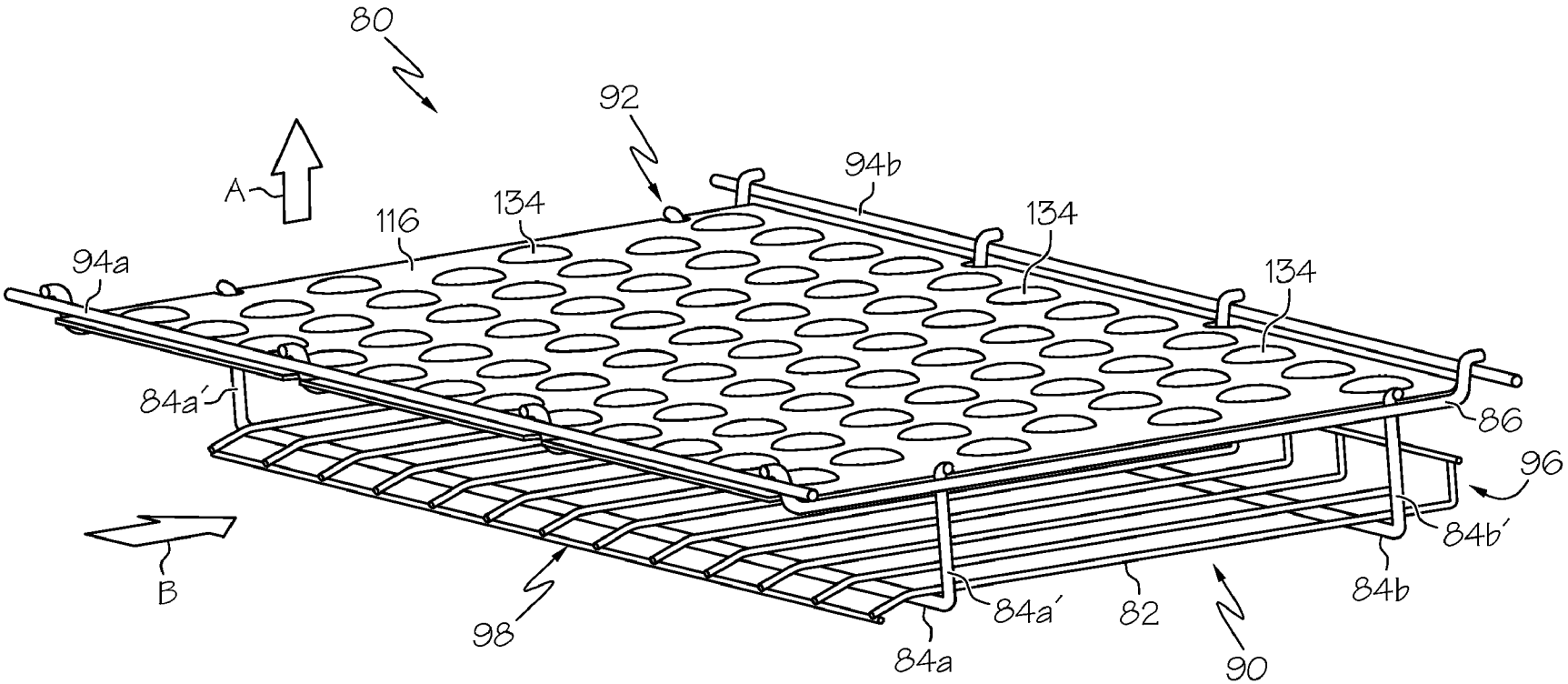
FIG. 10 illustrates a perspective view of yet another example construction of a fast freeze shelf in accordance with another aspect of the present invention.
Figure 11:
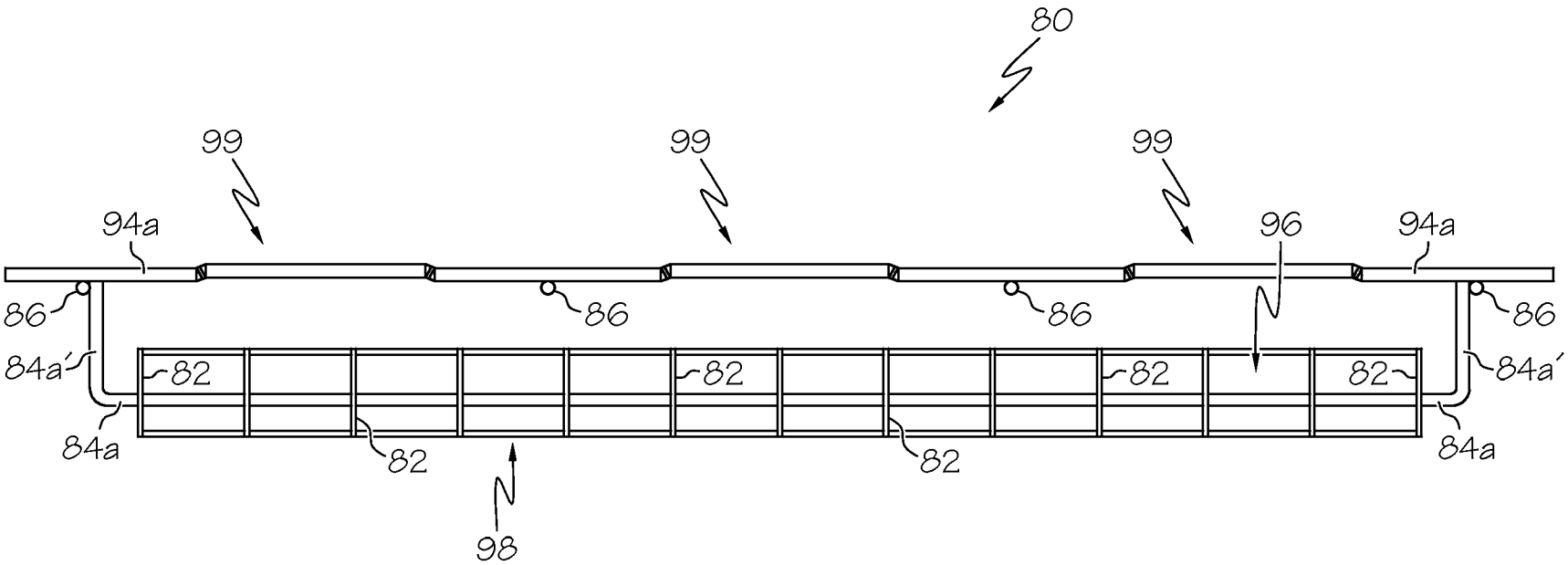
FIG. 11 illustrates a front view of an example lower support portion of the fast freeze shelf of FIG. 10.

Turning now to FIGS. 10-11, another example support rack 80 is illustrated for supporting the thermally conductive shelf 116 of FIGS. 6-9 within the freezer compartment 14. As before, the support rack 80 can be of wire-form construction, and can include any or all of the laterally spaced wires 82, front, rear, and side wires 84*a*, 84*b*, 86, and additional support wires (not shown), etc. However, as shown, the front and rear wires 84*a*, 84*b* can be configured to extend generally upwards 84*a*', 84*b*' to couple the lower and upper support portions 90, 92 together. In other words, the upper and lower support portions 90, 92 can form a unitary body that is coupled to the freezer compartment 14. For example, the front and rear wires 94*a*, 94*b* of the upper support portion 90 can be directly coupled to the freezer compartment 14, while the lower support portion 92 is indirectly coupled to the freezer compartment 14 via the upper support portion 92.

The example rack 80 can also include various other features. In one example, the lower support portion 90 can include a backstop 96, formed from a rearward portion of the laterally spaced wires 82 that are turned upwards, to limit an insertion distance of the thermal sink(s) 22. In another example, the lower support portion 90 can include a tapered insertion portion 98 to facilitate insertion of the thermal sinks 22 onto to the lower support portion 90. For example, the tapered insertion portion 98 can be formed from a forward portion of the laterally spaced wires 82 that are angled away from the upper support portion 92 (e.g., generally downwards). The tapered insertion portion 98 can be beneficial when inserting the thermal sinks 22 (i.e., along the direction of arrow B) and causing vertical movement (i.e., lifting along the direction of arrow A) of the thermally conductive shelf 116. Note that the thermal sinks 22 have been removed for clarity, but would be arranged similar to those shown in FIG. 6. In addition or alternatively, as shown in FIG. 11, the front wires 94*a* of the upper support portion 90 can include stepped portions 99 arranged to generally coordinate with the location of the handles 24 of the thermal sinks 22 to provide greater space to facilitate gripping of the handles 24 by the hand of a user.

Figure 12:
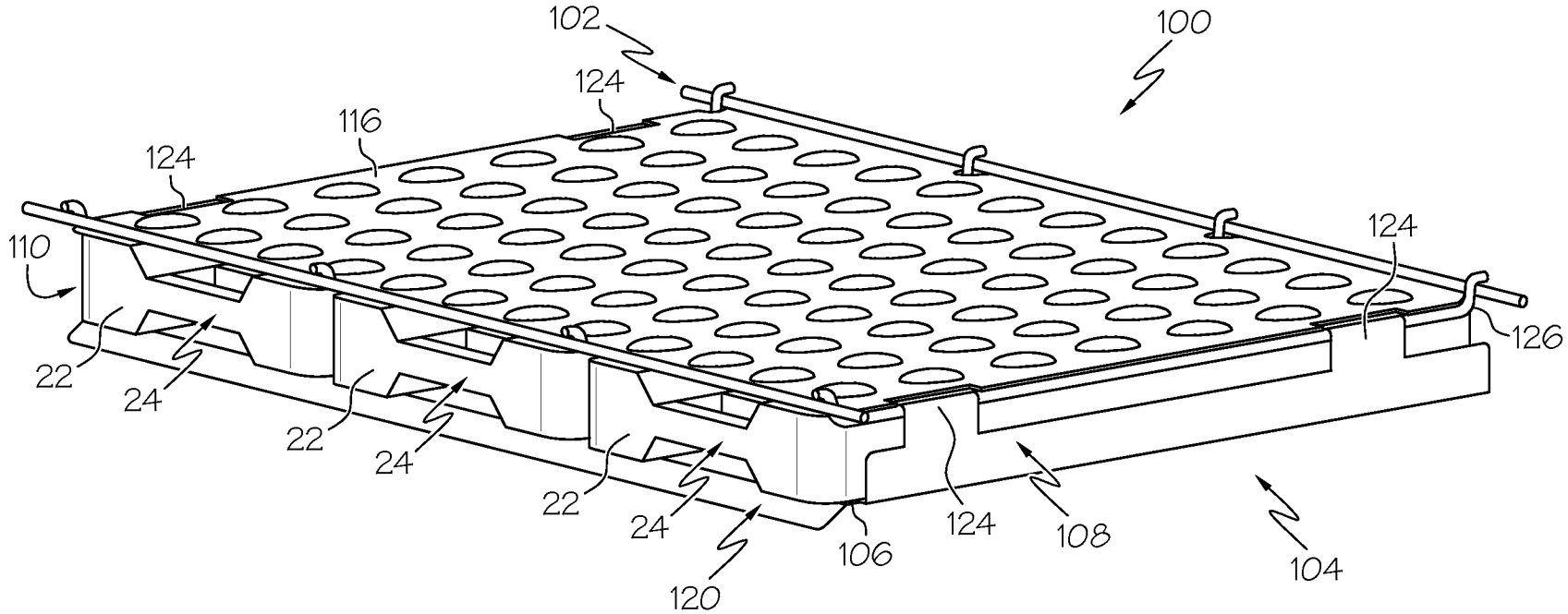
FIG. 12 illustrates a perspective view of still yet another example construction of a fast freeze shelf in accordance with another aspect of the present invention.
Figure 14:
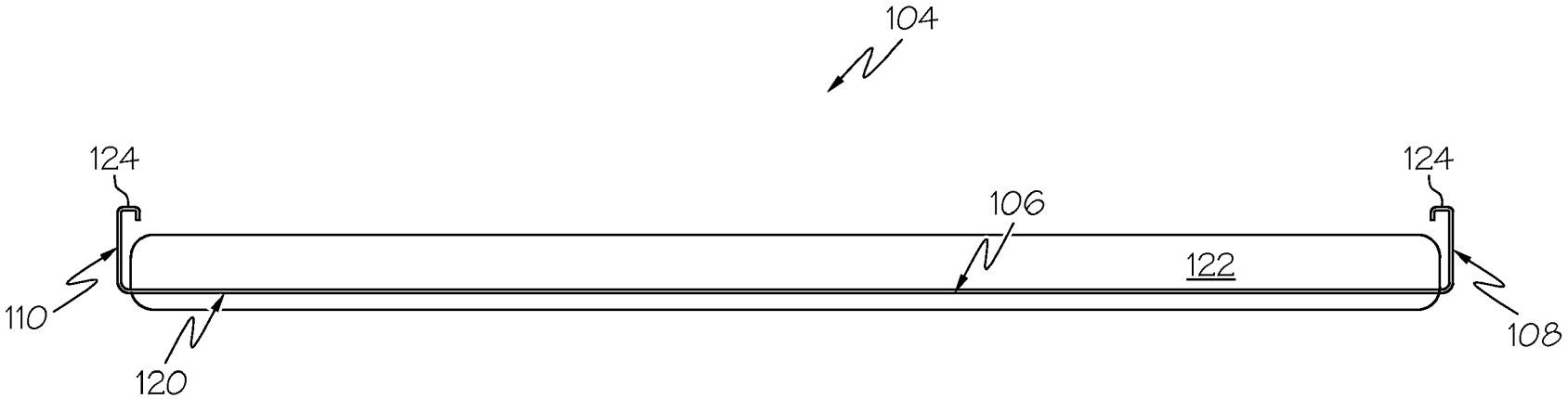
FIG. 14 illustrates a front view of the lower support portion of the fast freeze shelf of FIG. 12.

Turning now to FIGS. 12-14, yet another example support rack 100 is illustrated for supporting the thermally conductive shelf 116 of FIGS. 6-9 within the freezer compartment 14. As before, at least a portion of the support rack 100 can be of wire-form construction. Specifically, the upper support portion 102 can generally be of wire-form construction similar to the upper support portion 64 of FIGS. 6 and 8, and may be similarly configured to permit the shelf 116 to move vertically relative thereto.

However, the lower support portion 104 can be of generally unitary construction. In other words, the lower support portion 104 can be formed, molded, stamped, etc. from a single element, such as a single element of metal, plastic, hard rubber, etc. In one example, the lower support portion 104 can be formed of a metal, such as aluminum or steel. Still, the lower support portion 104 can be formed from a plurality of element coupled together (e.g., via mechanical fasteners, adhesives, welding, etc.) to form a generally unitary body. The lower support portion 104 can include a base 106 for supporting one or more thermal sinks 22, and opposed side walls 108, 110. In addition or alternatively, the lower support portion 104 can include a tapered insertion portion 120 to facilitate insertion of the thermal sinks 22 onto to the base 106 of the lower support portion 104. In addition or alternatively, the lower support portion 104 can include a rear wall 122 that can act as a backstop to limit an insertion distance of the thermal sink(s) 22.

In addition or alternatively, the upper support portion 102 can be directly coupled to the freezer compartment 14, while the lower support portion 104 is indirectly coupled to the freezer compartment 14 via the upper support portion 102. For example, the sidewalls 108, 110 of the lower support portion 104 can include one or more attachment portions 124, such as hooks, loops, etc, for coupling to a portion of the upper support portion 102. Thus, the lower support portion 104 can hang from the upper support portion 102. For example, as shown in FIG. 14, the attachment portions 124 can include hooks that are configured to wrap about a portion of the side wires 126 of the upper support portion 102. The attachment portions 124 can be removably or non-removably coupled to the side wires 126. In addition or alternatively, the attachment portions 124 and/or the side wires 126 can further include locking structure to inhibit inadvertent separation of the upper and lower support portions 102, 104. In addition or alternatively, the thermally conductive shelf 116 can include apertures 125 generally corresponding to the size, location, and number of the attachment portions 124 to permit the attachment portions 124 to be coupled to the side wires 126.

The lower support portion 104 can also include additional features and/or structure. In one example, the lower support portion 104 can include a plurality of ventilation apertures 128 extending through the base 106 (or even any of the side walls 108, 110 and rear wall 122). The ventilation apertures 128 can facilitate fluid communication between the cooled air within the freezer compartment 114 and the thermal sinks 22 to enhance the transfer of thermal energy between the freezer compartment 114 and the thermal sinks 22. In another example, the lower support portion 104 can include one or more dividers 130 coupled to or formed with the base 106 (or even any of the side walls 108, 110 and rear wall 122). The dividers 130 can act as guides to facilitate insertion and/or removal of the thermal sinks 22.

Figure 7:
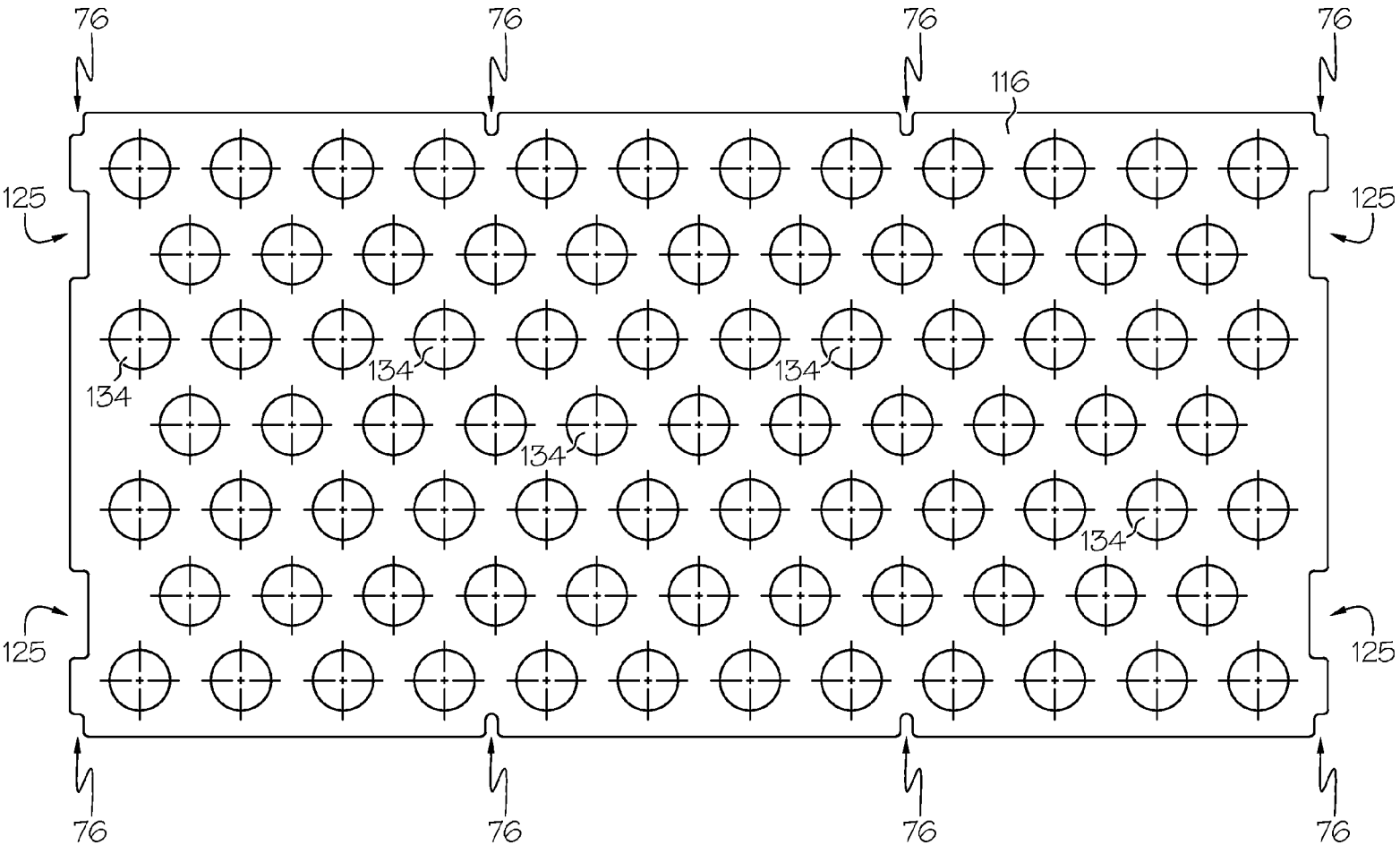
FIG. 7 illustrates a top view of an example thermally conductive shelf for the fast freeze shelf of FIG. 6.
Figure 8:
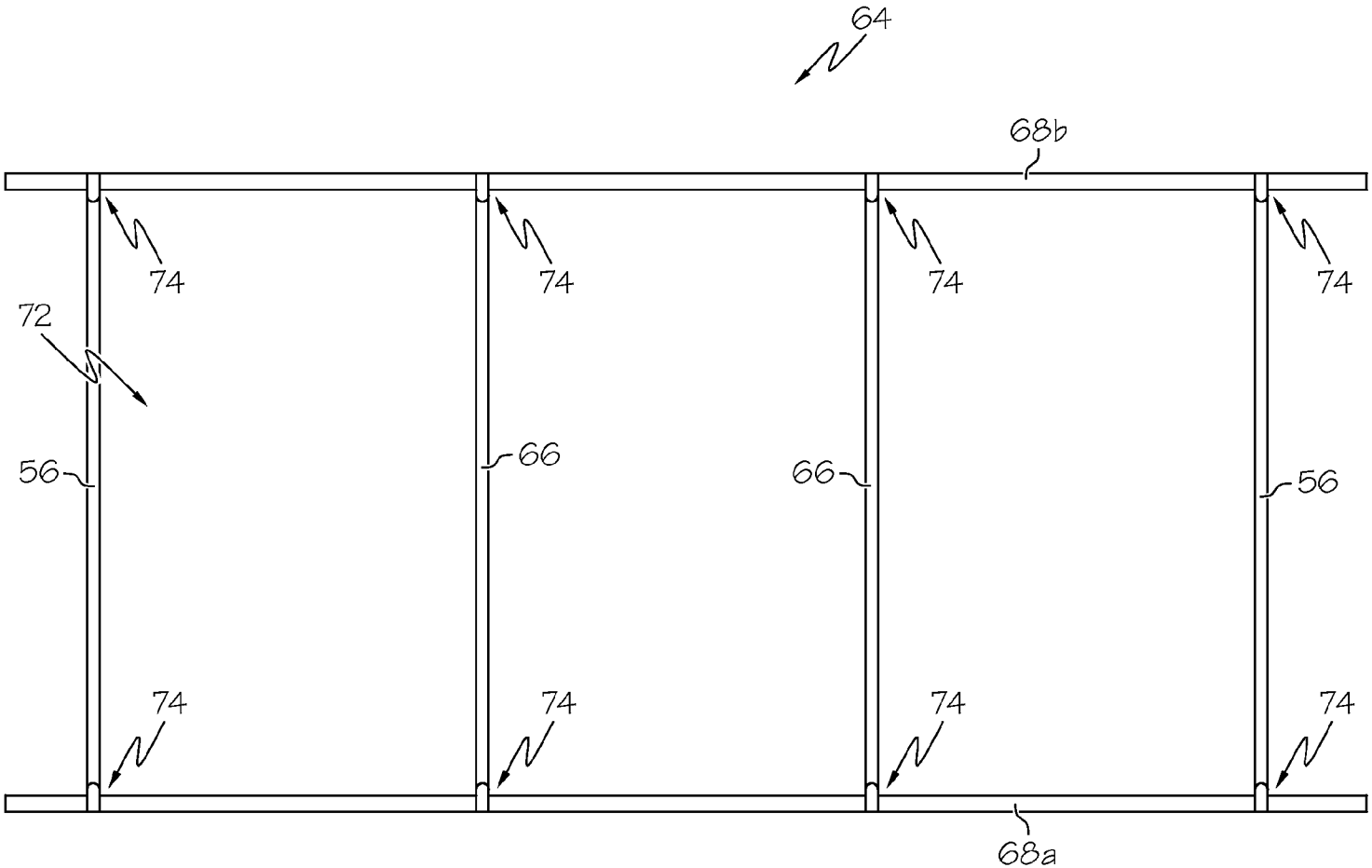
FIG. 8 illustrates a top view of an example upper support portion of the fast freeze shelf of FIG. 6.
Figure 9:
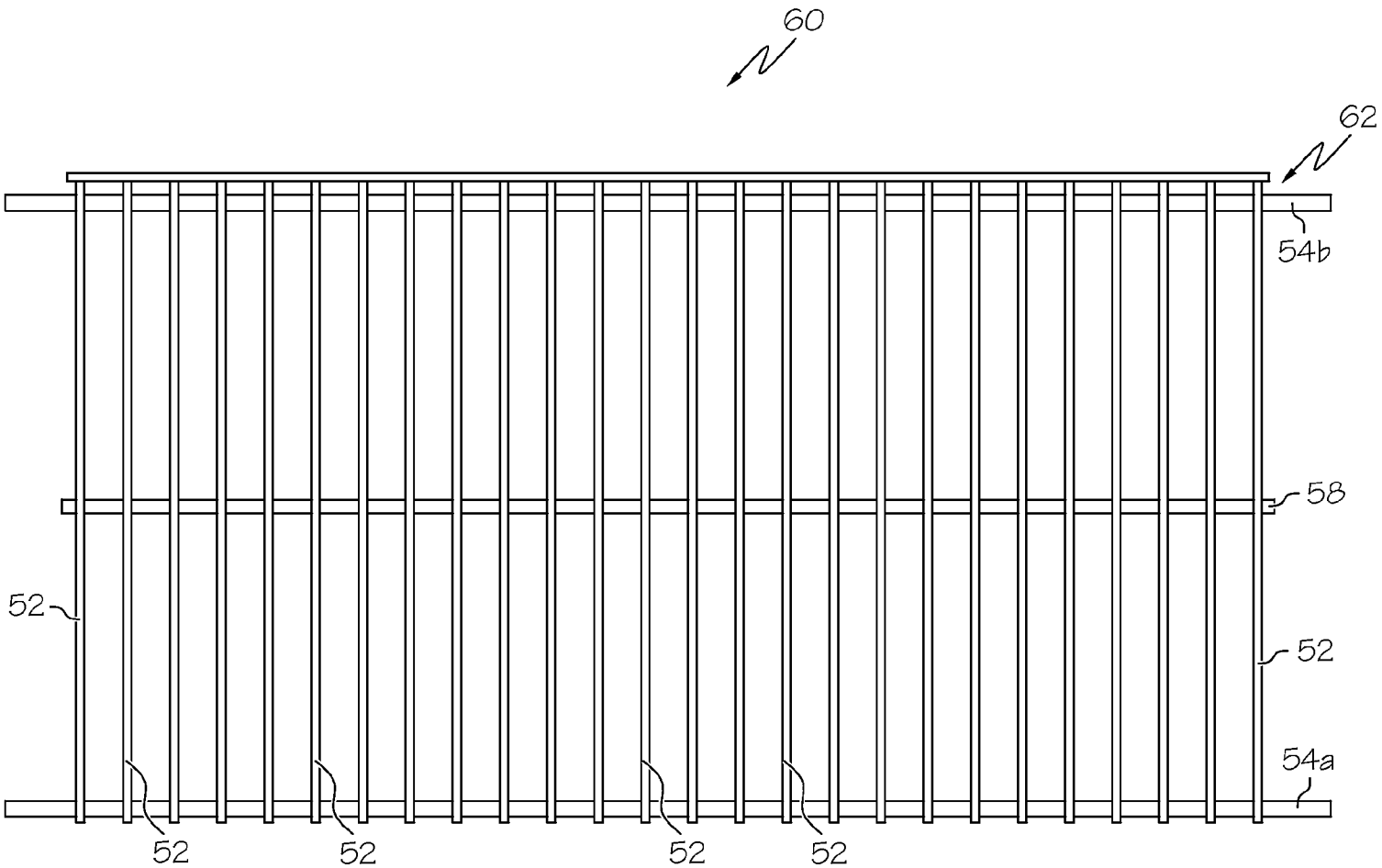
FIG. 9. Illustrates a top view of an example lower support portion of the fast freeze shelf of FIG. 6.

The thermally conductive shelf 16, 116, for use with any or all of the support racks 30, 50, 80, 100 described herein, can also include various other features for modifying the performance, durability, appearance, convenience, etc. of the shelf 16, 116. In one example, as shown in FIGS. 3-5, the thermally conductive shelf 16 can be relatively flat. In another example, the thermally conductive shelf 16 can include surface features for altering the transfer of thermal energy between the conductive shelf 16 and an object (not shown) supported upon the conductive shelf 16. For example, as shown in FIG. 2, the thermally conductive shelf 16 can have a plurality of holes 132 or other apertures/recesses arranged in various manners. In yet another example, the thermally conductive shelf 16, 116 can have various raised projections extending upwardly from a surface thereof, such as for modifying the heat transfer ability, defining particular cooling zones, controlling spills or leaks, providing enhanced structural integrity, etc. For example, as shown in FIGS. 7 and 10, the thermally conductive shelf 16, 116 can have a plurality of raised, domed projections 134 that can be arranged in a randomly or in a pattern, such as an array or the like. Similarly, the thermally conductive shelf 16, 116 can have various recesses, depressions, etc. (not shown). Further still, the thermally conductive shelf 16 can have various coatings or the like. In one example, the thermally conductive shelf 16 can be painted, powder coated, have a plastic, rubberized or silicone covering, etc.

Figure 15:
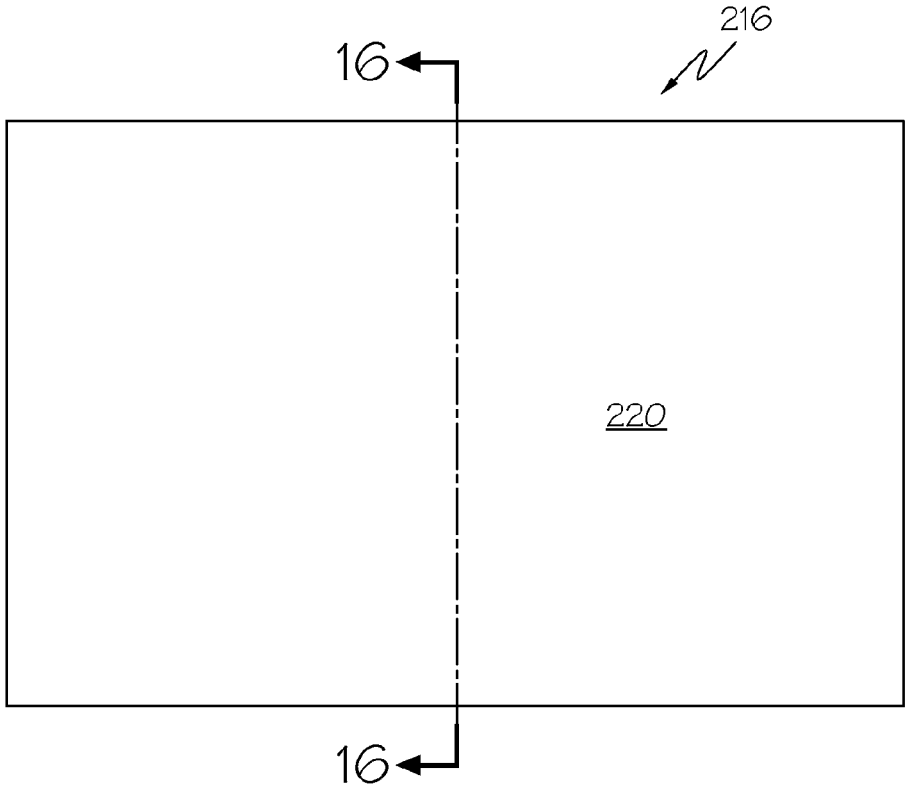
FIG. 15 illustrates a top view of another example thermally conductive shelf.
Figure 16:
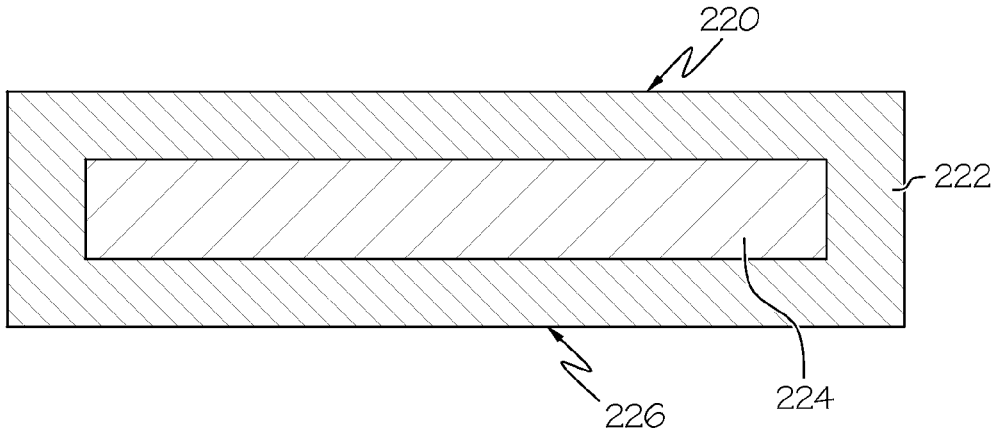
FIG. 16 is a sectional view of the thermally conductive shelf of FIG. 15.

The thermally conductive shelf 16, 116 has been previously described herein as a generally solid plate. Still, the shelf 16, 116 can also have various other configurations and/or constructions. Turning to FIGS. 15-16, in one example, the thermally conductive shelf 216 can include an outer shell 222 having a relatively high thermal conductivity wrapped or formed about a core 224. For example, the outer shell 222 can include a metal, such as aluminum, steel or the like, that is wrapped or formed about a core 224 of a different material. In one example, the outer shell 222 can have a relatively small thickness to reduce, such as minimize, weight and/or cost. The core 224 can include various other materials, such as a relatively cheaper material, like plastic, wood, rubber, etc. In other examples, the core 224 can include phase change material, such as water, gel, or the like that can change states depending upon the temperature. In still yet other examples, the core 224 can include a material having a relatively higher thermal conductivity, such as copper or the like. The outer shell 222 can be removably or non-removably wrapped about, coupled to, and/or formed about the core 224 in various manners. Thus, an upper surface 220 of the outer shell 222 can form the support surface for supporting various items within the freezer compartment 14. Additionally, a lower surface 226 of the outer shell 222 can be thermally coupled to the thermal sinks 22. It is to be understood that any or all of the features discussed previously herein regarding the shelf 16, 116 can also be applied to the instant shelf 216.

Further still, the fast freeze shelf 12 can also include various other auxiliary features. In one example, the thermally conductive shelf 16 can include various sensors (e.g., temperature sensors, frost sensors, timers, etc.) for monitoring performance of the shelf. The sensors could be electrically connected to control circuitry of the refrigeration appliance 10 for logging data and/or varying performance of the refrigeration system 17. Of course, the various sensors can be located at various locations relative to the thermally conductive shelf 16, and/or can even be located within or formed with the thermally conductive shelf 16. In another example, the shelf 12 can include locks, latches, and/or spring-loaded devices for retaining or releasing the various thermal sinks 22. In still yet another example, the shelf 12 can include fans or other air moving devices for increasing or decreasing the cooling time of items stored on the shelf 12. In still yet another example, the shelf 12 can include a heater or the like for controlling frost (e.g., a defroster) or the like.

In yet other examples, a portion of the shelf 12 can include a backstop or other structure for limiting movement of items stored on the shelf 12. In still yet another example, an auxiliary shelf (not shown) can be located below the lower support portion 34 for storing additional items and/or even additional thermal sinks 22. For example, the auxiliary shelf can be adapted to store relatively large or bulky items and/or thermal sinks 22. The auxiliary shelf can include through holes or the like to facilitate cold airflow therethrough.

In addition or alternatively, the shelf 12 can be combined with various other elements within the freezer or fresh food compartment. In one example, the shelf 12 can be used with a drawer or other dedicated storage compartment. In another example, the shelf 12 can be used with an ice maker for making or storing ice within either of a freezer or fresh food compartment. Indeed, the shelf 12 can even be adapted to form large or irregular ice blocks for use with the shelf 12 or in other applications.

Though the foregoing example has been illustrated for use in a freezer having a below freezing temperature, it is to be appreciated that the fast freeze shelf 12 of the present invention can also be utilized in a fresh food compartment of a refrigerator (e.g., a compartment maintained at an above-freezing temperature). Thus, for example, the fast freeze shelf 12 can be used in a fresh food compartment to quickly decrease the temperature of a product placed into the refrigerator down to an appropriate storage temperature. The fast freeze shelf 12 can also be utilized in a fresh food compartment to reduce, such as minimize, temperature fluctuations of items stored on the fast freeze shelf 12 that may be caused by adjacent warmer foods, an open compartment door, or the like. In other examples, the fast freeze shelf 12 can be utilized to increase performance of an ice maker located in either of the freezer or fresh-food compartments. Even further still, the fast freeze shelf 12 can also be utilized in portable applications that are actively or passively cooled, such as a portable or remote cooler or the like.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A refrigeration appliance, including:

an insulated cabinet forming an interior cavity;

a refrigeration system for cooling the interior cavity;

a thermally conductive shelf extending across at least a portion of the interior cavity to form a support surface;

at least one thermal sink operatively coupled to the conductive shelf and adapted to facilitate the transfer of thermal energy from the thermally conductive shelf; and a support rack coupled to a portion of the interior cavity including an upper support portion adapted to support the conductive shelf and a lower support portion adapted to support the at least one thermal sink, wherein the upper support portion is substantially coextensive with the lower support portion.

2. The refrigeration appliance of claim 1, wherein the at least one thermal sink is removable from the interior cavity without removal of the support rack.

3. The refrigeration appliance of claim 1, wherein the at least one thermal sink includes a plurality of thermal sinks, and wherein at least one of the plurality of thermal sinks is removable from the interior cavity without removal of the remaining plurality of thermal sinks.

4. The refrigeration appliance of claim 1, wherein the at least one thermal sink includes a handle.

5. The refrigeration appliance of claim 1, wherein the at least one thermal sink includes a thermally conductive material that becomes a liquid at a temperature above approximately zero degrees centigrade and a solid at a temperature below approximately zero degrees centigrade.

6. The refrigeration appliance of claim 1, wherein the at least one thermally conductive shelf includes a metal.

7. The refrigeration appliance of claim 1, wherein the thermally conductive shelf includes a projection extending upwardly from a surface thereof.

8. The refrigeration appliance of claim 1, wherein the thermally conductive shelf is coupled to the support rack for support of the conductive shelf within the interior cavity.

9. The refrigeration appliance of claim 8, wherein the thermally conductive shelf is supported upon the upper support portion and spaced from the lower support portion a distance generally equal to or less than a thickness of the at least one thermal sink.

10. The refrigeration appliance of claim 9, wherein the support rack is configured to permit the conductive shelf to be vertically moveable relative to the upper support portion, and wherein insertion of the thermal sink onto the lower support portion causes engagement of the thermal sink with the conductive shelf to move the conductive shelf a distance vertically upwards.

11. A refrigeration appliance, including:

an insulated cabinet forming an interior cavity;

a refrigeration system for cooling the interior cavity;

a thermally conductive shelf forming a support surface within the interior cavity; and a plurality of thermal sinks operatively coupled to the conductive shelf and adapted to facilitate the transfer of thermal energy from the thermally conductive shelf, wherein at least one of the plurality of thermal sinks is removable from the interior cavity without removal of the remaining plurality of thermal sinks.

12. The refrigeration appliance of claim 11, wherein at least one of the plurality of the thermal sinks includes a handle.

13. The refrigeration appliance of claim 11, wherein at least one of the plurality of the thermal sinks includes a thermally conductive material that becomes a solid at a temperature below approximately zero degrees centigrade.

14. The refrigeration appliance of claim 11, wherein the thermally conductive shelf includes a surface feature for altering the transfer of thermal energy between the conductive shelf and an object supported upon the conductive shelf.

15. The refrigeration appliance of claim 11, further including a support rack, wherein the insulated cabinet includes an upper wall, a lower wall, opposed first and second sidewalls extending between the upper and lower walls, and a rear wall extending between the upper and lower walls, the rack being coupled to at least one of the first wall, second wall, and rear wall, and wherein the thermally conductive shelf is coupled to the support rack for support of the conductive shelf within the interior cavity.

16. The refrigeration appliance of claim 15, wherein the support rack includes an upper support portion adapted to support the conductive shelf and a lower support portion adapted to support the thermal sink, the thermally conductive shelf being supported upon the upper support portion and spaced from the lower support portion a distance generally equal to or less than a thickness of the thermal sink.

17. A refrigeration appliance, including:

an insulated cabinet forming an interior cavity;

a refrigeration system for cooling the interior cavity;

a support rack operatively coupled to a portion of the interior cavity;

a thermally conductive shelf coupled to the support rack and extending across at least a portion of the interior cavity to form a support surface; and at least one thermal sink thermally coupled to the conductive shelf and adapted to facilitate the transfer of thermal energy from the thermally conductive shelf wherein the at least one thermal sink is removable from the interior cavity without removal of the support rack.

18. The refrigeration appliance of claim 17, wherein at least one the thermal sink includes a plurality of thermal sinks, and wherein at least one of the plurality of thermal sinks is removable from the interior cavity.

19. The refrigeration appliance of claim 17, further including a support rack coupled to a portion of the interior cavity, the support rack including an upper support portion adapted to support the conductive shelf and a lower support portion adapted to support the at least one thermal sink, the thermally conductive shelf being supported upon the upper support portion and spaced from the lower support portion a distance generally equal to or less than a thickness of the at least one thermal sink.

20. The refrigeration appliance of claim 19, wherein the support rack is a wire rack formed of a plurality of wires.

* * * * *